United States Patent [19]

Batts

[11] 4,395,799

[45] Aug. 2, 1983

[54] SPRING BIASED PLASTIC ARTICLE CLAMP

[75] Inventor: John H. Batts, Grand Rapids, Mich.

[73] Assignee: John Thomas Batts, Inc., Zeeland, Mich.

[21] Appl. No.: 277,167

[22] Filed: Jun. 25, 1981

[51] Int. Cl.[3] ..... A44B 21/00; A47J 51/14

[52] U.S. Cl. ..... 24/137 A; 223/96; D6/253

[58] Field of Search ..... 24/137 A; 223/96, 91, 223/93; D6/253

[56] References Cited

U.S. PATENT DOCUMENTS 10,311 12/1853 Hotchkiss et al. ..... 24/137 A

FOREIGN PATENT DOCUMENTS 843691 7/1952 Fed. Rep. of Germany ... 24/137 A
1158736 1/1958 France ..... 24/137 A
720827 11/1966 Italy ..... 24/137 A
398487 3/1966 Switzerland ..... 24/137 A
595158 11/1947 United Kingdom ..... 24/137 A

*Primary Examiner*—Robert Mackey
*Attorney, Agent, or Firm*—Price, Heneveld

[57] ABSTRACT

The disclosed garment hanger has an elongated, molded plastic body with clamps at each end. Each clamp has a pair of spaced legs interconnected by an integral web between its ends which holds the legs substantially spaced from each other. The web has a relatively thin central section which functions as a hinge. The legs are biased into clamping position by a spring which is suspended in a pocket between the handle portions of the clamps. The lower end of the spring has a substantially circular head which becomes distorted in shape and presses against the bottom of the handle portions of the legs and against the web as the clamp is opening for effecting a change in the operating characteristic of the clamp.

3 Claims, 9 Drawing Figures

SPRING BIASED PLASTIC ARTICLE CLAMP

FIELD OF THE INVENTION

This invention relates to molded plastic article hangers of the clamping type and particularly to such hangers designed for hanging clothing articles such as skirts, slacks and the like. The invention utilizes a body and a supporting hook with the ends of the body terminating in spring biased clamps which are used to grip and suspend the garment.

BACKGROUND OF THE INVENTION

Many types of clamping hangers having garment clamping means have been developed which are suitable for molding from plastic. An example of such a garment hanger is to be found in U.S. Pat. No. 3,767,092 entitled "Garment Clamping Hanger With Slidable Locking Clip", issued Oct. 23, 1973, to Judd F. Garrison et al. The clamp structure disclosed in that patent does not utilize a biasing spring. However, U.S. Pat. No. 4,192,441 entitled "Clamp Construction For Article Hangers", issued Mar. 11, 1980, to John H. Batts illustrates a clamping garment hanger utilizing a U-shaped internal spring to provide the clamping action. Other patents disclosing garment hangers with spring bias garment gripping clamps include U.S. Design Pat. No. 243,138 entitled "Garment Hanger", issued Jan. 25, 1977 to Herb Coon and U.S. Pat. No. 2,408,334 entitled "Coat Hanger Or Wall Rack", issued Sept. 24, 1946 to W. Scurrah. None of these patents discloses the particular type of spring construction of this invention nor do any of these patents disclose the particular functional interrelationship between the spring and the body structure of the clamp which is characteristic of this invention.

BRIEF DESCRIPTION OF THE INVENTION

The invention provides a generally H-shaped molded plastic body with the crossbar or connecting web of the H-shaped structure serving as the hinge or fulcrum about which the legs of the H are pivoted. On one side of the web, the legs serve as a clamp and on the other side of the H, the legs serve as handles for manipulating the clamp. Between the handle portions of the legs, a generally V-shaped spring is mounted, the divergent arms of which force the handles apart. At the convergent end of the arms the spring is formed into a generally circular head. The free ends of the arms of the spring are positively locked to the handles. The circular head portion of the spring is of such size and is so located that it does not engage the web when the handles are released and the jaws closed but it does engage the web as the handles ae squeezed together to open the clamping jaws. A channel-like arrangement is provided within the pocket formed between the handles which channel in the web is of just sufficient depth to seat the spring and hold it against lateral movement. This arrangement provides a clamp with a spring of sufficient strength that the clamp can positively hold heavy garments. The construction provides a spring seat which is positive in the sense that it holds the spring against inadvertent release, even though the spring is relatively strong and, therefore, when compressed has a strong tendency to try to detach from the clamp. With springs of the strength desirable to provide the clamp with the gripping power necessary to hold heavy garments, inadvertent release of the spring can be a problem. Also, the design of the spring and its precise location with respect to the web and the handle portions of the clamp body provides a stabilizing support for the web or hinge which both structurally strengthens the clamp and materially adds to its durability by preventing distortion of the plastic material as the clamp is used. Also, the construction effectively conceals the spring from both the front and the back of the hanger. This is particularly desirable since hangers of this construction are normally used to display garments at the point of retail sale.

DESCRIPTION OF THE PREFERRED EMBODIMENT

Figure 1:
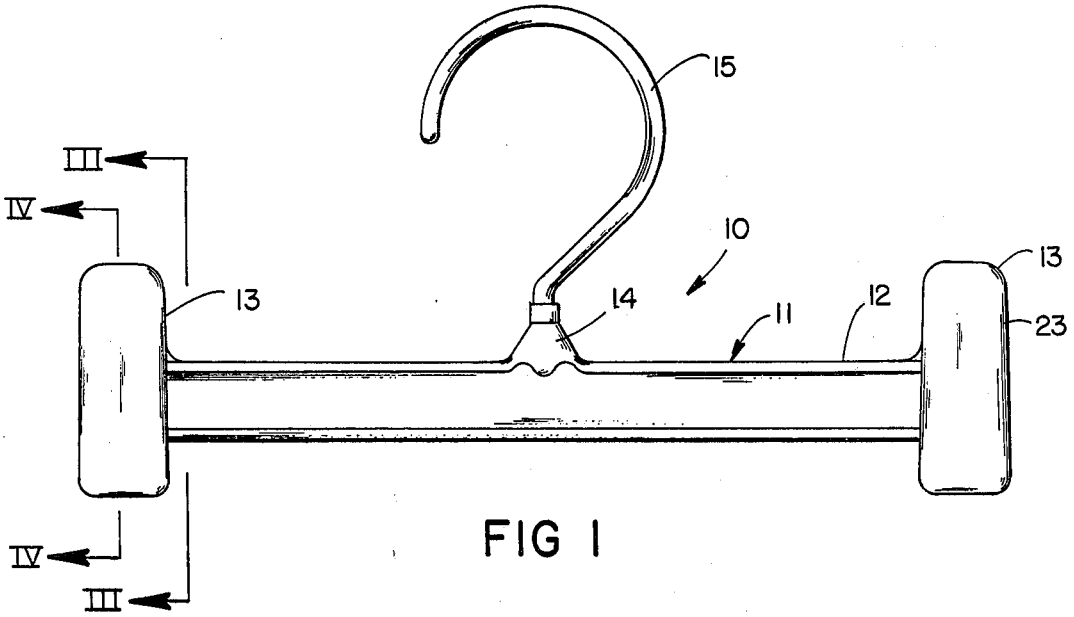
FIG. 1 is a front view of a hanger incorporating this invention.
Figure 2:
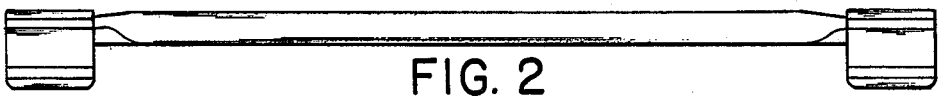
FIG. 2 is a bottom view of the hanger.
Figure 9:
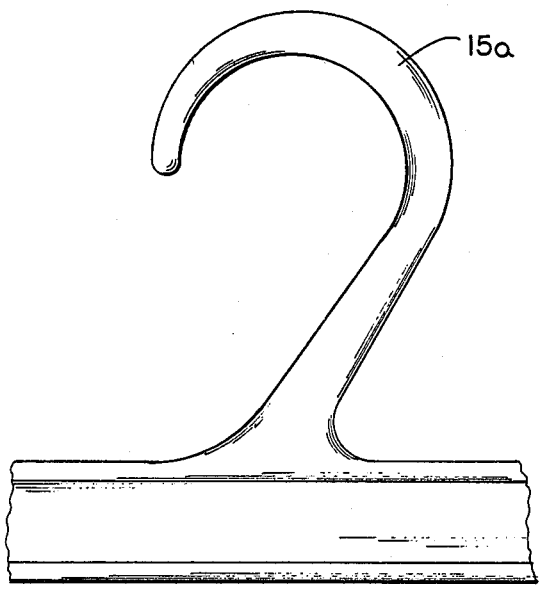
FIG. 9 is a fragmentary view of a modified support hook for the hanger.

Referring to FIG. 1, the numeral 10 indicates a hanger having a body member 11 consisting of an elongated beam portion 12 on the end of which are a pair of clamps 13. At the center of the beam is an upstanding boss 14 to which is attached a suitable supporting hook 15. The entire body, including the beam 12, the clamps 13 and the boss 14, are all molded as a single integral part from a suitable plastic such as polypropylene or high impact polystyrene. For the sake of rigidity and strength the beam 12 is preferably of I-beam type cross section. The hook can be of wire and attached as a separate element or molded as a hook 15*a* integral with the body (FIG. 9).

Figure 3:
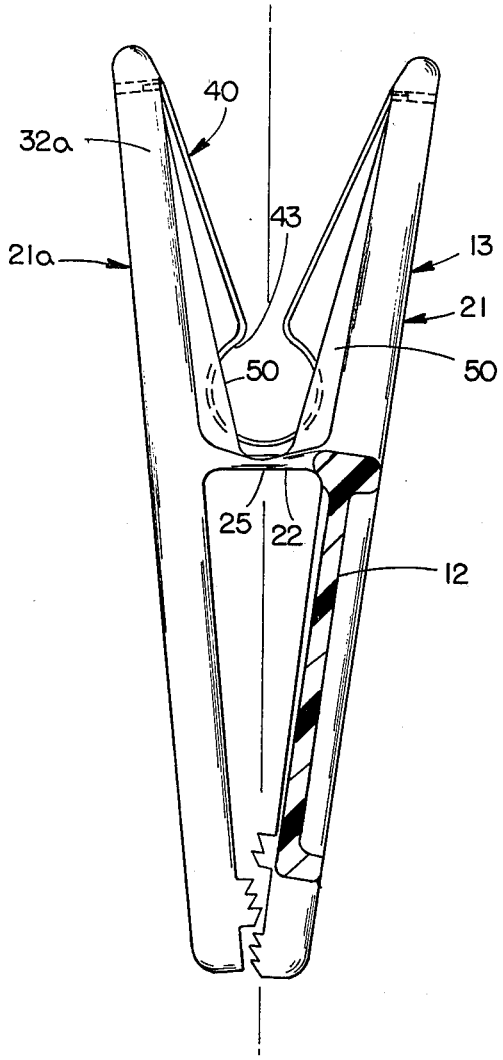
FIG. 3 is an enlarged sectional, elevation view taken along the plane III—III of FIG. 1.
Figure 4:
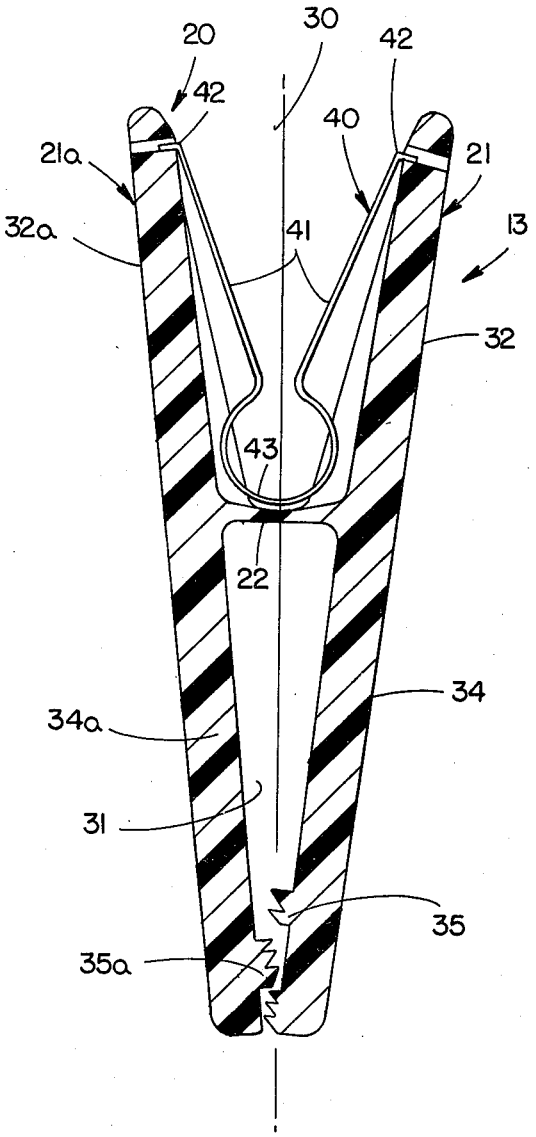
FIG. 4 is an enlarged sectional, elevation view taken along the plane IV—IV of FIG. 1.
Figure 6:
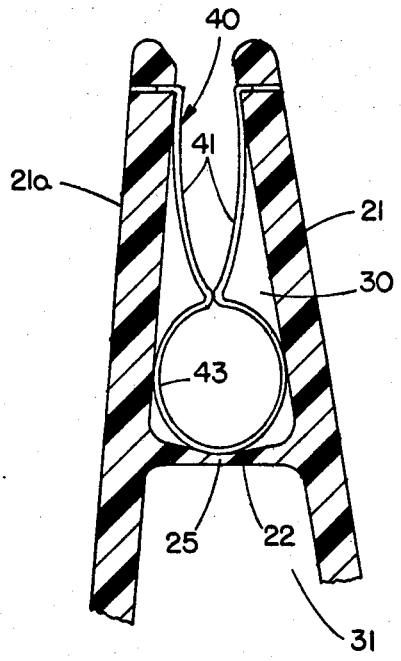
FIG. 6 is a fragmentary, sectional view similar to FIG. 4 illustrating the relationship of the spring to the body of the clamp when the clamp is opened against the resistance of the spring.

The clamps 13 are identical. Therefore, a description of one will be considered to suffice as a description of both. Each clamp consists of a body 20 having a pair of elongated leg portions 21 and 21*a* joined intermediate their ends by a bar or web 22. The web 22 is of substantial length and is located somewhat closer to the upper end of the leg portions than to the lower end of the leg portions. The web 22 is tapered in vertical cross section from each of the legs 21 and 21*a* and, at its center, has a relatively thin section 25 which flexes and functions as a hinge or fulcrum about which the leg 21*a* can be pivoted. As initially molded, the body 20 has the general shape of the letter H, the legs of which are substantially spaced apart. The leg 21 is integral with the beam 12 and, therefore, remains stationary with respect to the remainder of the hanger structure (FIG. 3).

The web 22 divides the interior of the clamp into an upper or handle pocket 30 and a lower article receiving or clamping pocket 31. The portions of the legs 32 and 32*a* defining the sides of the pocket 30 form the handles of the clamp, and the portions 34 and 34*a* of the legs defining the sides of the garment pocket form the gripping jaws of the clamp. The lower portions of the inside faces of the gripping jaws are equipped with teeth 35 and 35*a* for securing articles which are inserted into the pocket while the clamp is open.

Figure 7:
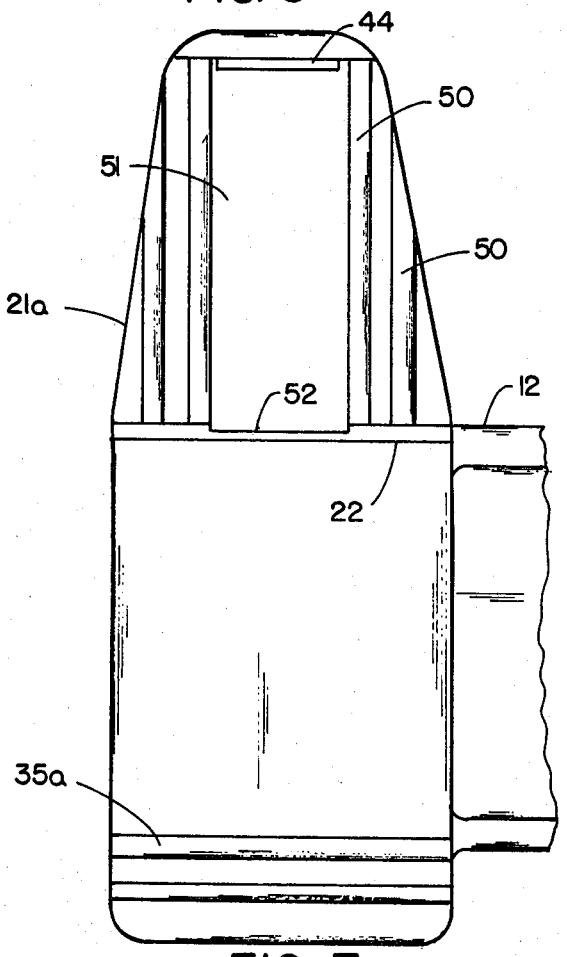
FIG. 7 is a sectional, elevation view taken along the plane VII—VII of FIG. 5.

Seated within the handle pocket 30 is a spring 40. The spring is generally V-shaped having a pair of divergent arms 41 the free ends of which are flanged outwardly to form anchors 42. At the convergent ends of the arms the spring is formed into a generally circular head 43. The arms of the spring at the time of installation, are partially pressed together to load the spring and provide a closing bias to the clamp. The anchors 42 are seated in slots 44 in the ends of the handles (FIG. 7). This arrangement makes a very positive attachment of the spring to the body of the clamp, preventing the spring from inadvertently discharging through the end of the pocket 30.

Figure 5:
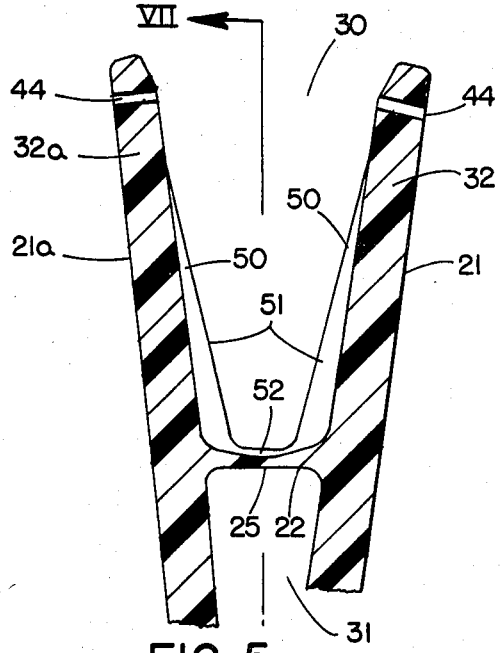
FIG. 5 is a fragmentary, sectional view similar to FIG. 4 with the spring omitted.
Figure 8:
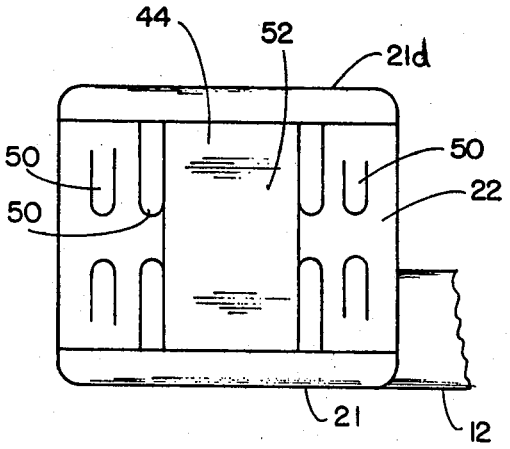
FIG. 8 is a fragmentary, plan view of the hanger body with the spring omitted.

The width of the spring is less than that of the handles 32 and 32*a*. On each side of the spring, reinforcement ribs 50 are provided (FIGS. 7 and 8). The ribs 50 are of increasing depth as they extend toward the web 22 and their lower ends are integral with the web. The lower ends of the ribs reinforce and stiffen the web 22 on each side of the thin section 25 forcing the bending to occur at that section. The ribs also reinforce and stiffen the handles 32 and 32*a* against bending under the pressure exerted by the spring. The ribs are arranged in pairs on each side of a channel 51 which extends lengthwise of each handle and is centered between its sides. The width of the channel is slightly greater than that of the spring. At the bottom of the handles, the ends of the channels are joined by a recess 52 formed in the top of the web 22 (FIG. 5).

When the clamp is fully closed and the handles 32 and 32*a* are at maximum divergence, the outer diameter of the head portion 43 of the spring is less than the spacing between the bottoms of the channels 51 and the length of the spring is such that the head 42 does not engage the bottom of the recess 52 in the web 22. Thus, the spring, in effect, is suspended within the pocket 30 from its anchors 42. However, as the handles are pressed together, the shape of the spring changes with first the sides of the spring head 43 bottoming in the channels 51. As the handles are further pressed together, the sides of the spring at the neck portion where the arms 41 and head 43 are joined engage each other. As the handles are moved still closer together, the shape of the head is distorted and its shape becomes somewhat elongated forcing its lower end to shift downwardly and seat against the web 22 in the bottom of the recess 52. As these changes in the spring's shape occur, its resistance to further compression increases, increasing the force of the clamping action. Thus, as thicker and heavier garments are loaded on the hanger, necessitating further spreading of the jaws, the clamping force is increased to assure adequate gripping action. As this change in the spring's shape occurs, the resistance of the web 22 to further downward distortion of the spring materially increases the spring's resistance. Also the spring serves to prevent the web 22 from inadvertently buckling upwardly. The sides of the recess 52 provide positive stops against the spring 40 shifting sideways under compression loading as the clamp is opened.

The invention provides a heavy duty garment hanger particularly suitable for hanging thick and heavy garments or other articles such as carpet samples or heavy bathmats. The construction of the spring and its physical interrelationship with the sides and bottom of the pocket in which it seats provides a clamping grip capable of securing and supporting heavy articles such as winter clothing or the like even under such severe service conditions as prolonged transport in trucks where the loads are subject to vibration and the shock of rough handling incident to loading and unloading. Therefore, the hanger is particularly suitable for garment shipment.

The hanger is also desirable for retail display. Its positive holding characteristics are desirable in eliminating the problem of garments falling to the floor because of repeated customer handling or gradual release of the garments from the clamps. Because the springs are concealed from both the front and back, the hangers have an attractive appearance which enhances rather than detracts from the appearance of the merchandise.

Having described the preferred embodiment of the invention, it will be recognized by those skilled in the art that modifications can be made without departing from the principles of the invention. Such modifications are to be considered as included in the hereinafter appended claims unless these claims, by their language, expressly state otherwise.

I claim:

1. A spring biased molded plastic article clamp for article hangers having a one-piece body, said clamp being H-shaped and having a pair of legs joined intermediate their ends by a web having a flexible central section capable of functioning as a hinge; the portions of said legs extending in one direction from said web forming handles and the portions of said legs extending in the opposite direction from said web forming article gripping jaws, said handle portions and said web defining a generally U-shaped pocket therebetween; a channel recessed into the inner faces of said handle portions and into the adjacent face of said web; a spring having a circular head and a pair of divergent legs entirely seated within said pocket, the ends of said legs being secured to said handle portions adjacent the free ends thereof and suspending said spring in said pocket and urging said handles apart; a portion of said head being received in and spaced from the bottom of said channel and from said web when said handles are divergent and seated against said web in said recess when said handle portions are pivoted into convergent position, said spring head providing position control for said web during manipulation of said clamp.

2. The spring biased one piece molded plastic article clamp described in claim 1 wherein said arms and head form a pair of closely spaced opposed transition sections at their juncture, forming a narrow throat, the sides of said throat shifting into abutment as the legs are pivoted to open the clamp forcing the head portion of the spring to become elongated and press downwardly against said web thereby supporting the web and increasing the resistance of the spring.

3. The spring biased one piece molded plastic article clamp described in claim 1 wherein inwardly projecting ribs extend lengthwise of the inner face of said legs, said ribs being on each side of said spring and defining the channel therefor, the bottom ends of said legs being integral with said web on opposite sides of its central section and stiffening and reinforcing both said legs and said webs.

* * * * *

UNITED STATES PATENT AND TRADEMARK OFFICE

CERTIFICATE OF CORRECTION

PATENT NO. : 4 395 799

DATED : August 2, 1983

INVENTOR(S) : John H. Batts

It is certified that error appears in the above-identified patent and that said Letters Patent is hereby corrected as shown below:

Column 1, line 29:

"2 408 334" should be --2 408 344--

Column 4, line 51:

"arms" should be --spring legs--

Column 4, line 61:

"legs" should be --clamp legs--

Signed and Sealed this

*Seventeenth* Day of *April 1984*

[SEAL]

*Attest:*

GERALD J. MOSSINGHOFF

*Attesting Officer*

*Commissioner of Patents and Trademarks*